US011162319B2

(12) United States Patent
Stralow et al.

(10) Patent No.: US 11,162,319 B2
(45) Date of Patent: Nov. 2, 2021

(54) INJECTION SYSTEMS FOR SUBTERRANEAN WELLBORES

(71) Applicant: EOG Resources, Inc., Houston, TX (US)

(72) Inventors: Josh Stralow, Midland, TX (US); Dominic Palmieri, Midland, TX (US)

(73) Assignee: EOG RESOURCES, INC., Houston, TX (US)

( * ) Notice: Subject to any disclaimer, the term of this patent is extended or adjusted under 35 U.S.C. 154(b) by 0 days.

(21) Appl. No.: 16/797,847

(22) Filed: Feb. 21, 2020

(65) Prior Publication Data

US 2020/0270963 A1 Aug. 27, 2020

Related U.S. Application Data

(60) Provisional application No. 62/809,032, filed on Feb. 22, 2019.

(51) Int. Cl.
*E21B 33/068* (2006.01)
*E21B 34/02* (2006.01)
*E21B 43/26* (2006.01)

(52) U.S. Cl.
CPC ..... *E21B 33/068* (2013.01); *E21B 34/02* (2013.01); *E21B 43/26* (2013.01)

(58) Field of Classification Search
CPC ..... E21B 33/068; E21B 34/02; E21B 43/26; E21B 43/2607
See application file for complete search history.

(56) References Cited

U.S. PATENT DOCUMENTS 2,708,140 A * 5/1955 Reed ..... E21B 43/26 406/76
2,955,654 A * 10/1960 Stognerjoelm ..... E21B 33/138 166/75.15
2,981,335 A 4/1961 Bucy et al.
4,169,504 A 10/1979 Scott
6,575,247 B2 6/2003 Tolman et al.
(Continued)

FOREIGN PATENT DOCUMENTS

CN 205577966 U 9/2016
WO 2018/143918 A1 8/2018

OTHER PUBLICATIONS

International Patent Application No. PCT/US2020/019295 International Search Report and Written Opinion dated Jun. 19, 2020 (14 pages).

*Primary Examiner* — Matthew R Buck
(74) *Attorney, Agent, or Firm* — Conley Rose, P.C.

(57) ABSTRACT

A diverter injection system is disclosed herein along with systems and methods relating thereto. In an embodiment, the diverter injection system includes a system inlet and a system outlet. In addition, the diverter injection system includes a canister including an internal volume configured to retain diverter therein. Further, the diverter injection system includes a first flow path extending between the system inlet and the system outlet that bypasses the canister, and a second flow path that extends from the system inlet, through the canister, and then to the system outlet. Still further, the diverter injection system includes a plurality of valves, wherein actuation of the plurality of valves is configured to selectively switch between the first flow path and the second flow path.

18 Claims, 6 Drawing Sheets

(56) References Cited

U.S. PATENT DOCUMENTS

| | | | | |
|---|---|---|---|---|
| 7,059,345 | B2 * | 6/2006 | Shaw | G05D 16/208 137/565.35 |
| 9,027,652 | B2 * | 5/2015 | Cherewyk | E21B 23/08 166/373 |
| 9,109,422 | B2 | 8/2015 | Ferguson et al. | |
| 10,704,373 | B2 * | 7/2020 | Dusterhoft | E21B 43/26 |
| 2006/0191718 | A1 * | 8/2006 | Harder | E21B 10/42 175/54 |
| 2012/0211219 | A1 | 8/2012 | McGuire et al. | |
| 2013/0032327 | A1 | 2/2013 | He et al. | |
| 2013/0140020 | A1 | 6/2013 | Suarez-Rivera et al. | |
| 2013/0341030 | A1 | 12/2013 | Brannon et al. | |
| 2014/0027114 | A1 * | 1/2014 | Luharuka | E21B 43/267 166/263 |
| 2016/0326859 | A1 | 11/2016 | Crews et al. | |
| 2017/0226842 | A1 | 8/2017 | Omont et al. | |
| 2017/0292344 | A1 | 10/2017 | Watson et al. | |
| 2018/0163504 | A1 | 6/2018 | Watson et al. | |
| 2018/0209243 | A1 | 7/2018 | Watson et al. | |
| 2018/0238147 | A1 | 8/2018 | Shahri et al. | |
| 2018/0274349 | A1 | 9/2018 | Ciezobka et al. | |
| 2019/0257172 | A1 | 8/2019 | Watson et al. | |

* cited by examiner

INJECTION SYSTEMS FOR SUBTERRANEAN WELLBORES

CROSS-REFERENCE TO RELATED APPLICATIONS

This application claims benefit of U.S. provisional patent application Ser. No. 62/809,032 filed Feb. 22, 2019, and entitled "Injection Systems for Subterranean Wellbores," which is hereby incorporated herein by reference in its entirety.

STATEMENT REGARDING FEDERALLY SPONSORED RESEARCH OR DEVELOPMENT

Not applicable.

BACKGROUND

This disclosure relates generally to the injection of materials into a subterranean wellbore. More particularly, this disclosure relates to the injection of materials (such as, for example, diverter materials), into a subterranean wellbore during wellbore operations (e.g., a hydraulic fracturing or drilling operations).

Diverter material (which may be referred to more simply herein as "diverter") is injected into a wellbore to temporarily block off flow paths within a subterranean formation. After a period of time, the diverter dissolves such that the previously blocked flow paths within the formation are once again open (e.g., for subsequent production operations).

A hydraulic fracturing operation generally involves the injection of high pressure fluid (e.g., water) into the wellbore to produce fractures within the rock strata of the surrounding formation, to thereby ultimately increase the production of a particular well. As a result of various factors, such as, for example variations in the density or strength of the subterranean formation, the formation of cracks may not be evenly distributed within the region of pressure stimulation during a fracturing operation. In addition, fractures may open up during these operations that provide an outlet for the injected fluid (and thus pressure) into a subterranean pressure sink (e.g., a region of lower density rock, an adjacent wellbore, a cavity, etc.) so that additional fractures may not be formed in the formation. As a result, diverter may be introduced into the rock formation to locally and temporarily block these initial fractures within the formation so that so that additional fractures may be formed therein. Once the diverter is dissolved (or substantially dissolved), the previously blocked fractures as well as the newly formed fractures are open to produce formation fluids (e.g., oil, gas, condensate, water, etc.) into the wellbore and ultimately to the surface.

BRIEF SUMMARY

Some embodiments disclosed herein are directed to a diverter injection system, including a pump having a discharge. In addition, the diverter injection system couples between the discharge of the pump and a subterranean well. The diverter injection system includes a system inlet and a system outlet. In addition, the diverter injection system includes a canister including an internal volume configured to retain diverter therein. Further, the diverter injection system includes a first flow path extending between the system inlet and the system outlet that bypasses the canister and a second flow path that extends from the system inlet, through the canister, and then to the system outlet. Still further, the diverter injection system includes a plurality of valves, wherein actuation of the plurality of valves is configured to selectively switch between the first flow path and the second flow path.

Other embodiments are directed to methods of discharging a pressurized stream from a pump by flowing the pressurized stream through a first flow path of a diverter injection system during. The diverter injection system includes a system inlet, a system outlet, and a canister. The first flow path bypasses the canister and extends between the system inlet and the system outlet and a second valve is disposed along the connection line. The method includes closing the first valve and opening the second valve to switch from the flowing in the first flow path to the flowing in the second flow path.

Still other embodiments are directed to a diverter injection system including a system inlet configured to be coupled to a discharge of a pump, a system outlet configured to be coupled to a subterranean well, and a plurality of canisters each having an internal volume to hold diverter. In addition, the diverter injection system includes a main line extending from the system inlet to the system outlet, an inlet manifold coupled to an inlet of each of the plurality of canisters, a bypass line extending from the main line to the inlet manifold, and a plurality of connection lines each coupled between an outlet of a corresponding one of the plurality of canisters and the system outlet. Further, the diverter injection system includes a main valve disposed along the main line between the bypass line and the system outlet, and a plurality of canister valves each disposed along a corresponding one of the plurality of connection lines. The main valve and the plurality of canister valves are configured to actuate such that flow through the diverter injection system is to switch between: a first flow path extending from the system inlet to the system outlet along the main line, and a plurality of second flow paths each extending from the system inlet, through the bypass line, the inlet manifold, the corresponding one of the plurality of canisters, and the corresponding one of the plurality of connection lines to the system outlet. The internal volume of each of the canisters is configured to be in fluid communication with the system inlet when fluid is flowed through the first flow path and the plurality of second flow paths.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
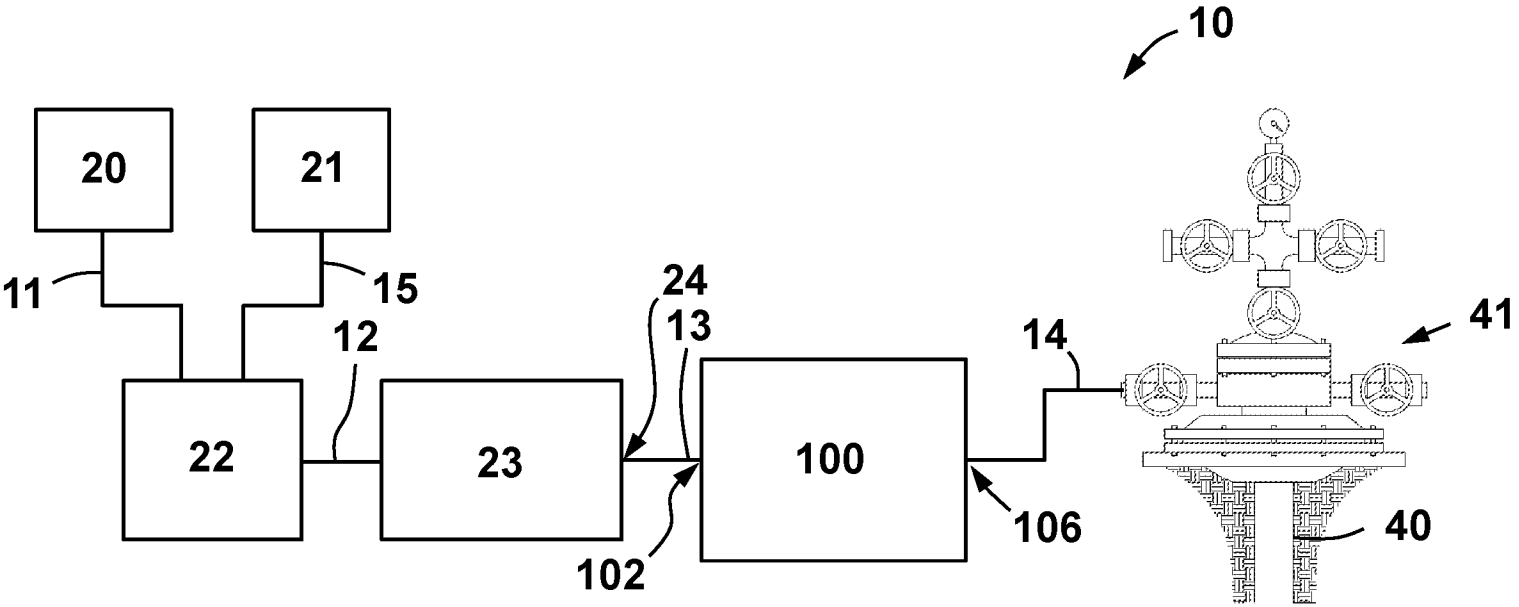
FIG. 1 is a block diagram illustrating a hydraulic fracturing system including a diverter injection system according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As previously described above, diverter may be used during wellbore operations to temporarily block off flow paths within a subterranean formation. Typically, when diverter is used in the context of a hydraulic fracturing operation (previously described), the diverter is mixed into the injected fluid and pumped or flowed through the high pressure pumps of the fracturing operation in order to deliver the diverter to the subterranean wellbore. However, this process includes shutting down various components of the hydraulic fracturing system (e.g., the high pressure pumps, blenders, etc.) into order to insert the diverter, which adds time, cost, and complexity to the overall hydraulic fracturing operation. In addition, in some circumstances flowing the diverter through rotating surface equipment (e.g., blenders, pumps, etc.) may cause flow blockages, or even damage to the equipment or the diverter itself.

Accordingly, embodiments disclosed herein include systems and methods for injecting diverter directly into a high pressure stream (e.g., such as an output from a high pressure pump within a hydraulic fracturing or fracking system). As a result, the disclosed systems and methods allow diverter to be injected during a hydraulic fracturing operation without shutting down other rotating equipment, such as, for example pumps, blenders, etc. In addition, the disclosed systems and methods provide a relatively high degree of control over diverter injection timing as well as diverter type and concentration, so as to increase the effectiveness of the injected diverter during operations.

While specific embodiments discussed herein include systems and methods for injecting diverter into a subterranean wellbore during a hydraulic fracturing operation, it should be appreciated that embodiments of the disclosed systems and methods may be used in other wellbore operations. For example, in some embodiments, one or more of the disclosed systems may be used to inject materials (e.g., diverter) into a wellbore during drilling operations (e.g., to selectively inject diverter or loss circulation material into a well when drilling mud losses are encountered). Thus, descriptions of the disclosed systems and methods within a hydraulic fracturing operation are merely illustrative of one potential use thereof, and should not be interpreted as limiting all potential uses and implementations.

Referring now to FIG. 1, a hydraulic fracturing system 10 for performing a high pressure hydraulic fracturing operation within a subterranean well 40 is shown. Generally speaking, hydraulic fracturing system 10 includes a mixer unit or blender 22, a pump assembly 23, and a diverter injection system 100. Each of these components is fluidly coupled to one another via lines 12, 13, 14. As used herein, the term "lines" (such as used to referred to lines 12, 13, 14, etc.) refers to any suitable conduit or channel capable of flowing or communicating fluids therethrough. For example, the term "line" may refer to a pipe, hose, open channel, duct, etc. In this embodiment, lines 12, 13, 14 may comprise one or a plurality of such conduits or channels between the corresponding components of system 10. During operations, fluid (e.g., slurry) is flowed from blender 22 to pump assembly 23 via line 12, is flowed from pump assembly 23 to diverter injection system 100 via line 13, and is flowed from diverter injection system 100 to subterranean wellbore 40 via line 14. Thus, diverter injection system 100 is downstream of pump assembly 23 which is downstream of blender 22.

Blender 22 includes one or more augers, blades, and/or other suitable mixing components that are configured to mix multiple ingredients or component during operations. During a hydraulic fracturing operation, blender 22 receives water and proppant (e.g., sand particles) from sources 20 and 21, respectively. Sources 20, 21 may comprise any suitable storage mechanism such as, for example, one or more tanks, boxes, trucks, etc. In addition, in this embodiment, sources 20, 21 deliver water and proppant, respectively, to blender 22 via lines 11 and 15, respectively, which may comprise any suitable conveyance, such as those described above for lines 12, 13, 14. For instance, in some embodiments, line 11 may comprise a pipe or hose, while line 15 may comprise a continuous belt. In some embodiments, water and/or proppant are inserted into blender 22 in batches (e.g., a load of proppant may be inserted into blender 22 with suitable equipment). Regardless of how the proppant and water are delivered to blender 22 from sources 20, 21, the blender 22 is configured to mix these components into a slurry (which may be referred to herein as "frac fluid") and then flow or provide this slurry to pump assembly 23 via line 12.

Pump assembly 23 comprises one or more pumps (or other pressurization devices) that are configured to pressurize the slurry emitted from blender 22 for injection into subterranean wellbore 40 via line 13, diverter injection system 100, and line 14. Pump assembly 23 is configured to pressurize the slurry to relatively high pressures (e.g., pressures ranging from 1000 to 15,000 psi or more), and then emit the pressurized slurry from an outlet or discharge 24 into line 13. Thus, the pressure of fluids flowing through line 13 is at a relatively high pressure during a hydraulic fracturing operation. Pump assembly 23 may utilize any suitable pumping mechanism(s), such as, for example, centrifugal pumps, positive displacement pumps, screw pumps, etc.

Generally speaking, diverter injection system 100 is in fluid communication between pump assembly 23 and subterranean well 40 via lines 13 and 14, respectively, and is configured to selectively inject diverter into the pressurized slurry flowing through line 13. Thus, diverter injection system 100 is configured to selectively inject diverter into subterranean well 40 during a hydraulic fracturing operation. During these operations, diverter injection system 100 may inject diverter into slurries that include proppant, and those that do not include proppant. For example, in some embodiments, when it is desired to inject diverter into subterranean well 40 via diverter injection system 100, proppant is not provided to blender 22, so that the pressurized fluid flowing from pump assembly 23 via line 13 at the time of diverter injection is free (or substantially free) of proppant. However, in other embodiments, diverter injection system 100 may inject diverter into a slurry that includes proppant.

Once the pressurized slurry (with or without diverter injected therein) is emitted from diverter injection system 100, it is communicated to subterranean well 40 via line 14. In particular, fluids flowing through line 14 are communicated to subterranean well 40 through a suitable surface assembly 41, which in this embodiment comprises a surface tree, where it is communicated with a subterranean formation (not shown). If diverter is injected into the slurry via diverter injection system 100, the diverter may temporarily block fractures or other flow paths within the formation as previously described. Further details of embodiments of diverter injection system 100 are discussed below.

Figure 2:
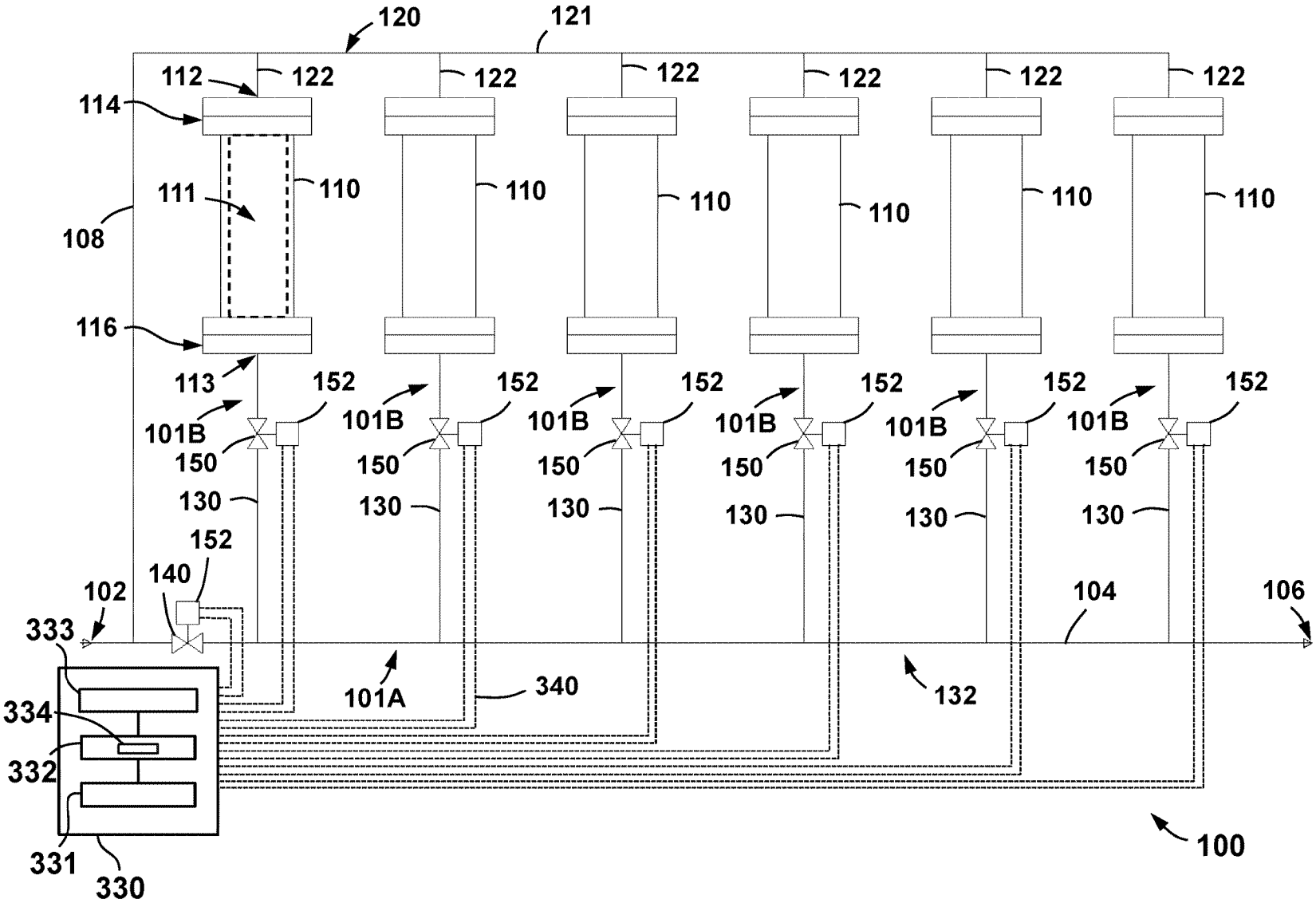
FIG. 2 is a piping and instrumentation diagram of a diverter injection system that may be used within the system of FIG. 1 according to some embodiments.
Figure 3:
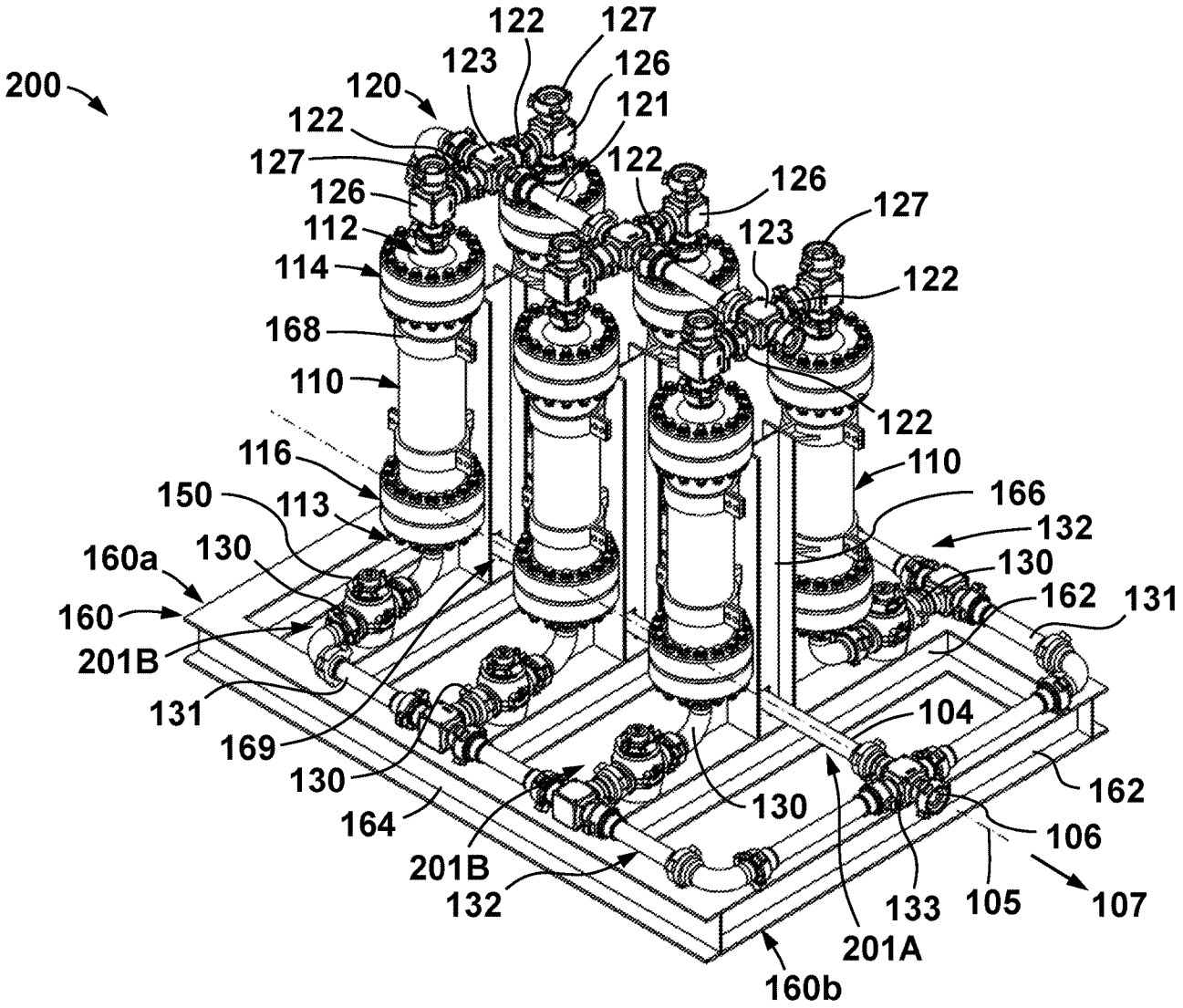
FIG. 3 is a perspective view of another diverter injection system that may be used within the system of FIG. 1 according to some embodiments.

Referring now to FIG. 2, a piping and instrumentation diagram of an embodiment of diverter injection system 100 is shown. In this embodiment, diverter injection assembly 100 comprises a system inlet 102 (which is more simply referred to herein as "inlet 102") that is coupled to discharge 24 of pump assembly 23, a system outlet 106 (which is more simply referred to herein as "outlet 106"), and plurality of canisters 110. When diverter injection system 100 is incorporated into system 10 of FIG. 1, inlet 102 is coupled to the discharge 24 of pump assembly 23 and outlet 106 is coupled to subterranean well 40. In addition, diverter injection system 100 includes a first or main flow line 104, a second or bypass line 108, an inlet manifold 120, and a plurality of connection lines 130. Generally speaking, main flow line 104 extends between inlet 102 and outlet 106, bypass line 108 extends from main line 104 to inlet manifold 120, inlet manifold 120 extends between bypass line 108 and canisters 110, and the plurality of connection lines 130 extend from canisters 110 to main line 104, downstream of bypass line 108.

Each canister 110 defines an internal volume 111 (which is shown in hidden line for one of the canisters 110 in FIG. 2), an inlet 112 into internal volume 111, and an outlet 113 from internal volume 111. Internal volume 111 is configured to receive diverter therein preceding operations. Thus, canisters 110 function as tanks for holding or storing a volume of diverter preceding operations, and may therefore be generally referred to herein as tanks, volumes, enclosures, and the like.

Inlet manifold 120 includes a first or primary line 121 that is fluidly coupled to bypass line 108, and a plurality of branch lines 122 that are fluidly coupled to primary line 121. In addition, each of the branch lines 122 are in parallel so that each is in direct fluid communication with primary line 121. In addition, each of the branch lines 122 is in fluid communication with corresponding ones of inlets 112 of canisters 110 via a first or upper flanged connection 114. Similarly, each of the connection lines 130 extends between corresponding ones of outlets 113 of canisters 110 and main line 104. More specifically, each of the connection lines 130 are in parallel fluid communication with main line 104 between bypass line 108 and outlet 106 so that each of the connection lines 130 is in direct fluid communication with main line 104. Further, each connection line 130 is in fluid communication with outlet 113 of the corresponding canister 110 via a second or lower flanged connection 116. Together, connection lines 130 and main line 104 form an outlet manifold 132 for receiving flow from canisters 110 during operations.

Referring still to FIG. 2, diverter injection system 100 also includes a plurality of valves for controlling the flow of fluid and/or diverter therethrough during operations. In particular, in this embodiment, system 100 includes a first or main valve 140 disposed along main line 104 between bypass line 108 and the plurality of connection lines 130, and a plurality of canister valves 150 disposed along corresponding ones of connection lines 130. In this embodiment, valves 140, 150 each include an actuator 152 that is configured to actuate the corresponding valve 140, 150 between an open position (where fluid is free to flow through the corresponding valve), a closed position (where fluid is restricted or totally prevented from flowing through the corresponding valve), or a position between the open and closed positions. Any suitable actuation method may be used by actuators 152, such as, for example, electrical actuation, hydraulic actuation, pneumatic actuation, or combinations thereof. In addition, in this embodiment, each of the actuators 152 is coupled to and is thus controlled by a controller 300 via a plurality of conductive paths 340. Conductive paths 340 may be any suitable connection (e.g. wired connections such as metal wires, fiber optic lines, etc.) and/or wireless connection (e.g., WIFI, BLUETOOTH, radio frequency signals, infrared signals, near field communication, etc.) and/or mechanical connection (e.g. hydraulic or pneumatic).

Generally speaking controller 330 selectively actuates valves 140, 150 (e.g., by sending suitable actuation signals to actuators 152 via conductive paths 340) to selectively emit diverter from one or more of canisters 110 (e.g., from internal volumes 111 of selected canisters 110) into main line 104 and outlet 106 as previously described above. Controller 330 may be a dedicated controller for operating diverter injection system 100 or may be included within a central controller or control assembly for a larger system (e.g., for hydraulic fracturing system 10).

In particular, controller 330 may comprise any suitable device or assembly which is capable of receiving an electrical or mechanical signal and transmitting various signals (e.g., again electrical, mechanical, hydraulic, light, pressure, etc.) to other devices (e.g., actuators 152, etc.). In particular, as shown in FIG. 2, in this embodiment controller 330 includes a processor 331, a memory 332, and a power source 333. The processor 331 (e.g., microprocessor, central processing unit, or collection of such processor devices, etc.) executes machine-readable instructions 334 provided on memory 332, and upon executing the machine-readable instructions 334 on memory 332 provides controller 330 with all of the functionality described herein. Memory 332 may comprise volatile storage (e.g., random access memory), non-volatile storage (e.g., flash storage, read only memory, etc.), or combinations of both volatile and non-volatile storage. Data consumed or produced by the machine-readable instructions 334 can also be stored on memory 332. Power source 333 may be any suitable device for storing electrical power (e.g., capacitor, battery, etc.). In some embodiments, power source 333 may comprise an external power source (e.g., municipal power source, generator power source, etc.). During operations, power source 333 provides electrical power to memory 332 and processor 331, and (in some embodiments) to actuators 152.

Referring now to FIGS. 1 and 2, during operations pump assembly 23 emits a high pressure fluid (e.g., which may or may not include proppant as previously described above) into line 13 so that these fluids are communicated to inlet 102 of diverter injection system 100. Initially, when no diverter is to be injected into subterranean well 40, valves 140, 150 are actuated (e.g., via controller 330 and the corresponding actuator 152 to the open position) so that the fluid is flowed across valve 140, through main line 104 to outlet 106 (where it is then communicated with subterranean well 40 via line 14 as previously described above). During this process, the high pressure fluids are allowed to communicate with internal volumes 111 of canisters 110 via bypass line 108 and inlet manifold 120; however, valves 150 are all actuated (e.g., via controller 330 and actuators 152) to the closed positions, and thus, flow through the canisters 110 is prevented. As a result, diverter which is stored within internal volumes 111 of canisters 110 is exposed to the high pressure of outlet 24 of pump assembly 23, but is prevented from flowing out of canisters 110 and into main line 104 by the closed valves 150.

When it becomes desirable to inject diverter into subterranean well 40 (e.g., if the pressures measured within the well indicate a loss of flow into a pressure sink as described in more detail below), controller 330 may actuate one or more of canister valves 150 to an open (or partially open) position so that high pressure fluid may flow through the corresponding canister(s) 110 from inlet manifold 120 (particularly the corresponding branch line(s) 122), through internal volume 111 and into the corresponding connection line(s) 130 and finally into main line 104 and outlet 106. In some embodiments, when fluid is flowing through the selected canisters 110 as described above, main valve 140 may be closed, partially closed, or open.

Thus, diverter injection system 100 defines a first flow path 101A that bypasses canisters 110 thereby emitting a diverter free stream of fluids from outlet 106, and a plurality of second flow paths 101B that each extend through one of canisters 110 to provide diverter to outlet 106 and subsequently subterranean well 40 during operations. In particular, the first flow path 101A extends from inlet 102, through main line 104, to outlet 106. Conversely, each of the second flow paths 101B extend from inlet 102 through bypass line 108, inlet manifold 120, one of the canisters 110 and connection lines 130, and back into main line 104 to outlet 106. Because there are total of six canisters 110 in this embodiment, there are a total of six second flow paths 101B defined within diverter injection system 100. In some embodiments, before initiation of operations (e.g., hydraulic fracturing operations) all lines 104, 108, 121, 122, 130 and canisters 110 may be primed with liquid (e.g., slurry, water, etc.) so as to avoid interruptions in the liquid stream exiting outlet 106 due to trapped gas pockets.

In addition, when actuating valves 140, 150 to switch between first flow path 101B and second flow paths 101B, or between different ones of second flow paths 101B, the actuation timing of valves 140, 150 by controller 330 may be set to avoid pressure spikes (e.g., a water hammer) to components within system 100 (or system 10). In particular, when switching the flow of high pressure fluid from first flow path 101A to one or more of second flow paths 101B, main valve 140 may be actuated to a closed position after the desired one or more of canister valves 150 are actuated to the open position, so that both sides of canister valves 150 are exposed to the same fluid pressure during the actuation. Similarly, when switching the flow of high pressure fluid from one or more of second flow paths 101B to first flow path 101A, open canister valves 150 may be closed after main valve 140 is opened (e.g., via controller 330), so that both sides of main valve 140 are exposed to the same fluid pressure during the actuation. However, it should be appreciated that valves 140, 150 may be actuated in any suitable order (e.g., simultaneously) during operations to switch between flow paths 101A, 101B in other embodiments.

Regardless of the relative actuation timing of valves 140, 150, during operations of at least some embodiments, when flow of the high pressure fluid is to be directed along one or more of second flow paths 101B to inject diverter into subterranean well 40, main valve 140 is ultimately completely closed so that all of the high pressure fluid (e.g., slurry) emitted from pump assembly 23 is redirected through the desired canisters 110 to thereby flush the diverter therefrom. Also, as previously described above, the high pressure flow may be directed along a plurality of the second flow paths 101B so as to introduced multiple volumes of diverter into subterranean well 40 during operations. Flow may be directed along the multiple second flow paths 101B simultaneously, or individually (e.g., sequentially) based on, for example, the desired injection rate and type of diverter.

Further, the actuation timing of valves 140, 150 to switch between first flow path 101A and one or more of second flow paths 101B may manipulated to control the rate of diverter injection from canisters 110 during operation. For example, in some instances an operator may wish to inject a high concentration slug of diverter (which is sometimes referred to as a "concentrated pill") into subterranean well 40. In these instances, the actuation of valves 140, 150 may be relatively fast so as to deliver the contents of the select canisters 110 to outlet 106 relatively quickly and in a relatively high concentration. Conversely, if an operator desires to inject a relatively diluted stream of diverter into subterranean well 40, the actuation of valves 140, 150 may be relatively slow. Thus, diverter injection system 100 may provide an enhanced level of control of diverter injection concentrations during operations.

Also, in some embodiments different types of diverter may be loaded into various canisters 110, so that the selective flowing of fluid along desired second flow paths 101B may result in the delivery of the different diverter types to subterranean well 40 during operations. This is advantageous in some instances as different downhole conditions may call for different diverter types or ingredients (or different combinations thereof) to effectively block off potential flow paths within the subterranean formation.

Still further, by including a plurality of separate canisters 110 within diverter injector system 100, isolation may be maintained between mutually reactive diverter materials and/or other chemical additives that may be stored within the separate canisters 110. In these embodiments valves 140, 150 may be actuated during diverter injection operations to inject multiple concentrated pills of reactive diverter components from separate canisters 110 between slugs of fluid (e.g., slurry), such that the reactive ingredients do not comingle until both reach the subterranean formation within subterranean well 40.

Referring still to FIGS. 1 and 2, in some embodiments, controller 330 may actuate main valve 140 and canister valves 150 via actuators 152 based on the output of one or more sensors disposed within system 10. For instance, in some embodiments, controller 330 may actuate valves 140, 150 so as to selectively flow fluid along one of the second flow paths 101B (e.g., to inject diverter into subterranean well 40) when a pressure sensor disposed within subterranean well 40 (not specifically shown) shows a drop in pressure during a hydraulic fracturing operation that may be characteristic of a loss of fluid and pressure within a pressure sink downhole (e.g., a cavity, low density region, adjacent well, etc.). In other embodiments, controller 330 may actuate valves 140, 150 so as to selectively flow fluid along the first flow path 101A and/or one or more of the second flow paths 101B (e.g., to inject diverter into subterranean well 40) as a result of other measured pressure variations (e.g., increases, decreases) within subterranean well 40. Additionally, in some embodiments, controller 330 may be coupled to or may otherwise communicate with pressure sensors disposed in another well (i.e., other than subterranean well 40), such as, for example an adjacent well. During operations in some of these embodiments, the controller 330 may determine if flow within subterranean well 40 (e.g., such as flow into well during a hydraulic fracturing operation) is being communicated to the adjacent well by noting a characteristic change (e.g., an increase) in pressure during hydraulic fracturing operations. In response, controller 330 may actuate flow through one or more of the second flow paths 101B to inject diverter and thus block off the communication path between the adjacent wells.

In addition, in some embodiments, actuators 152 and/or valves 140, 150 may be monitored for actuation position via sensors (not specifically shown) to control and or monitor the operation of diverter injection system 100. For instance, in some embodiments, pressure sensors (not shown) may be coupled to diverter injection assembly 100, and controller 330 (and/or some other controller) may monitor the fluid pressures sensed or detected by the pressure sensors within diverter injection system 100 to determine which valves 140, 150 are open (or partially opened) and which valves 140, 150 are closed. In some embodiments, position sensors (not shown) configured to measure or detect a position of the valves 140, 150 (or valving element(s) disposed therein) may be coupled to diverter injection assembly 100, and controller 330 (and/or some other controller) may determine which valves 140, 150 are open (or partially opened) and which valves 140, 150 are closed based on the output from the position sensors.

Referring now to FIGS. 3-6, an embodiment of diverter injector assembly 200 that may be used within hydraulic fracturing system 10 (see FIG. 1) in place of diverter injection system 100 is shown. Generally speaking, diverter injection assembly 200 includes the same features as those discussed above for the schematic representation of diverter injection assembly 100 shown in FIG. 2. Thus, many of the features of diverter injection system 100 are also included within diverter injection system 200 and such components are identified with the same reference numerals in FIGS. 3-6 in the interest of clarity and conciseness. As a result, much of the following discussion regarding diverter injection system 200 will focus on the components or features that are different or additional to those described above for diverter injection system 100. In this embodiment, diverter injection assembly 200 includes a longitudinal axis 105, and is mounted to a skid or base 160. In addition, as described above, diverter injection system 200 includes inlet 102 (see e.g., FIGS. 4-6), outlet 106, canisters 110, main line 104, bypass line 108, inlet manifold 120, connection lines 130, and valves 140, 150 as previously described above.

Skid 160 includes a first end 160*a*, a second end 160*b* opposite first end 160*a*, a pair of parallel longitudinal support beams 164 extending axially between ends 160*a*, 160*b*, and a plurality of parallel lateral support beams 162 that extend laterally between longitudinal support beams 164 such that each of the beams 164, 162 extend within a common plane. In addition, skid 160 includes a plurality of vertical support beams 166, which extend vertically upward from corresponding ones of lateral support beams 162.

Referring still to FIGS. 3-6, each of the plurality of canisters 110 is mounted to corresponding ones of vertical support beam 166, such that each canister 110 is generally vertically oriented with inlet 112 and upper flanged connection 114 disposed vertically above outlet 113 and lower flanged connection 116. In this embodiment, two canisters 110 are mounted to opposing sides (e.g., radially opposite sides with respect to longitudinal axis 105) of each vertical support beam 166 via mounting brackets 168. Thus, each canister 110 extends generally parallel to one another along skid 160. In this embodiment, there are a total of three vertical support beams 166, and thus, canisters 110 form two rows of three parallel canisters 110 atop skid 160; however, other arrangements and numbers of canisters 110 are possible and contemplated in other embodiments.

Referring still to FIGS. 3-6, in this embodiment, inlet 102 is disposed at first end 160*a* of skid, and outlet 106 is disposed at second end 160*b* of skid 160. In addition, main line 104 extends axially between inlet 102 and outlet 106 through apertures or notches 169 extending through vertical support beams 166. Further, bypass line 108 extends vertically upward from main line 104 at a junction or tee 103 that is axially adjacent inlet 102.

As previously described above, bypass line 108 extends to inlet manifold 120. In this embodiment, inlet manifold 120 is positioned above the plurality of canisters 110, and thus may be referred to herein as upper manifold 120 within diverter injection system 200. Upper manifold 120 comprises primary line 121 coupled to bypass line 108 (e.g., at an elbow connection in this embodiment), and the plurality of branch lines 122 as previously described. In this embodiment, primary line 121 extends axially from bypass line 108 and each of the branch lines 122 extend away from primary line 121 in a radial direction with respect to longitudinal axis 105. In this embodiment, because canisters 110 are arranged on radially opposing sides of vertical support beams 166 as described above, two branch lines 122 extend in radially opposite directions (e.g., with respect to longitudinal axis 105) from a plurality of junctions 123 that are axially spaced along primary line 121, with each branch line 122 coupled to upper flanged connection 114 of a corresponding one of canisters 110. Specifically, in this embodiment, each branch line 122 is coupled to upper flanged connection 114 of a corresponding one of canisters 110 via a junction 126. As shown in FIGS. 3-6, each junction 126 includes an upper connector 127. In this embodiment, upper connectors 127 are capped, but may be opened when desired to provide access to internal volume 111 of canisters 110 (e.g., for maintenance, repair, insertion or withdrawal of diverter, etc.)

Each of the plurality of connection lines 130 is coupled to and extends from lower flanged connection 116 of a corresponding one of canisters 110 as previously described above. Additionally, it should be noted that within diverter injection system 200, connection lines 130 are not directly connected to main line 104 as shown in FIG. 2 for diverter injection system 100. Rather, in this embodiment, connection lines 130 merge into a pair of outlet manifolds 132 that each extend to a connection point or junction 133 along main line 104, axially adjacent to outlet 106. More particularly, outlet manifolds 132 are disposed radially opposite one another about longitudinal axis 105 and each extends axially along corresponding ones of longitudinal support beams 164. Due to the positioning of canisters 110 about vertical support beams 166 as described above, in this embodiment, a first three of canisters 110 are coupled to one of the outlet manifolds 132, and the remaining three canisters 110 are coupled to the other of outlet manifolds 132 via the corresponding connection lines 130. Thus, in this embodiment, outlet manifold 132 comprises connection lines 130 and manifold lines 131.

Figure 5:
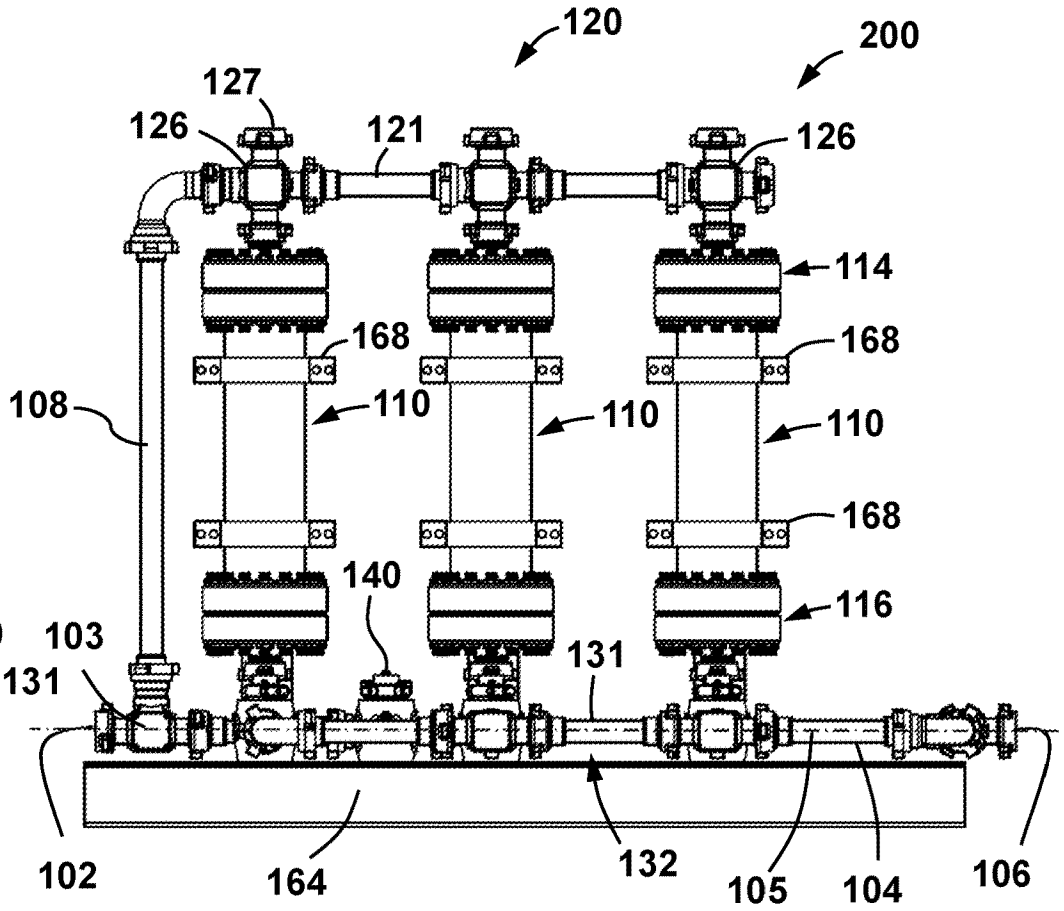
FIGS. 4, 5, and 6 are front, side, and top views, respectively, of the diverter injection system of FIG. 3.
Figure 4:
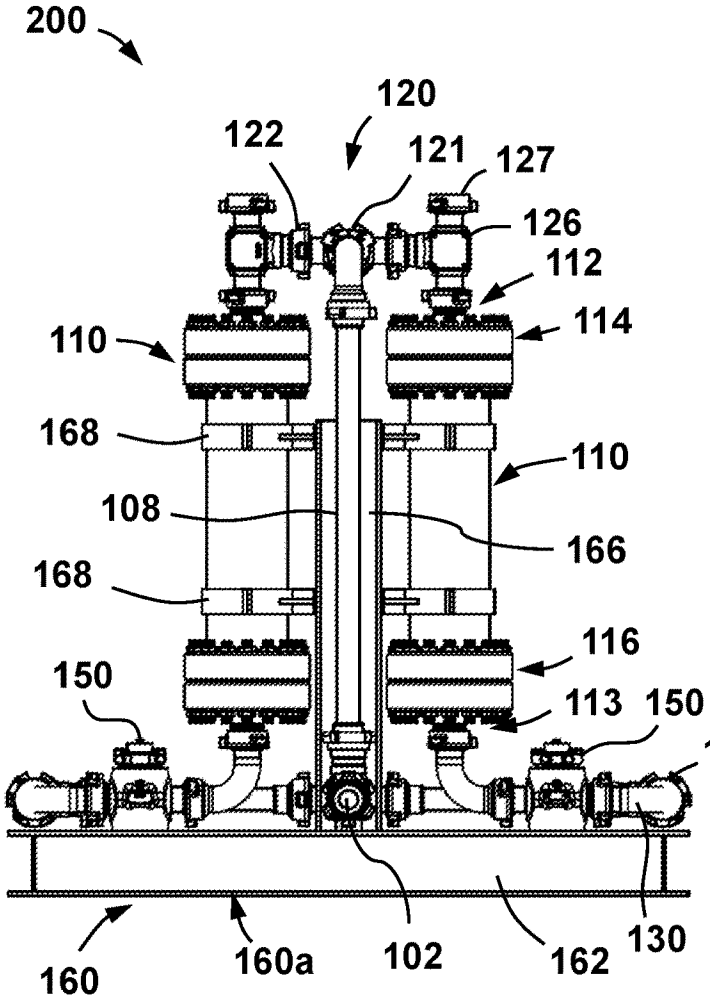
Figure 6:
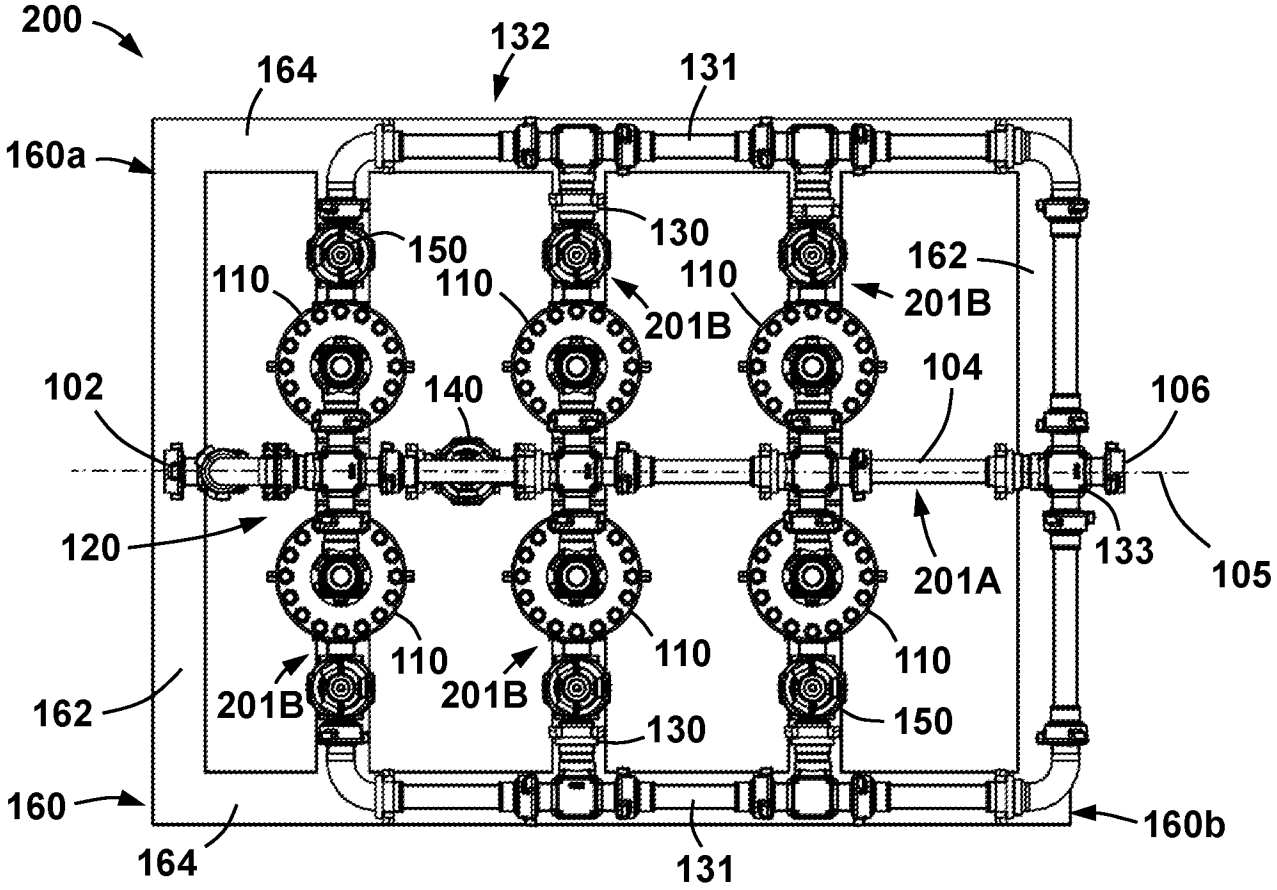

Referring still to FIGS. 3-6, diverter injection system 200 includes valves 140, 150 as previously described above for diverter injection system 100. In particular, as best shown in FIGS. 4 and 5, main valve 140 is disposed along main line 104 axially between bypass line 108 and junction 133 such that main valve 104 is disposed axially between a pair of vertical support beams 166 along main line 104. In addition, each canister valve 150 is disposed along a corresponding one of connection lines 130 between lower flange connection 116 and the corresponding manifold line 131 of outlet manifold 132. While not specifically shown in FIGS. 3-6, each valve 140, 150 includes a corresponding valve actuator (e.g., actuator 152 shown in FIG. 2) that is configured to actuate the corresponding valve 140, 150 between open, closed, and partially closed positions as described above. As with diverter injection system 100, actuators 152 of diverter injection system 200 may be electrically coupled (e.g., via suitable conductive paths such as paths 340 described above) to a controller (e.g., controller 330) that is configured to control the actuation of valves 140, 150 via actuators 152 as previously described above for diverter injection system 100.

Referring now to FIGS. 1 and 3-6, high pressure fracturing operations with the diverter injection system 200 are substantially the same as described above for diverter injection system 100. Thus, much this description is not repeated in the interests of brevity. However, it should be appreciated that diverter injection assembly 200 defines a first flow path 201A between inlet 102 and outlet 106 for bypassing canisters 110 and a plurality of second flow paths 201B between inlet 102 and outlet 106 for injecting diverter stored in canisters 110 into the pressurized output from pump assembly 23 (see FIG. 1) as described above for diverter injection assembly 100 (e.g., flow paths 101A, 101B previously described). In particular, in this embodiment, first flow path 201A within diverter injection assembly 200 extends axially from inlet 102 through main line 104 and junction 133 to outlet 106. In addition, the plurality of second flow paths 201B each extend from inlet 102, through bypass line 108, through corresponding ones of branch lines 122, canisters 110, connection lines 130, and manifold lines 131 to junction 133 and outlet 106. Because there are a total of six canisters 110 in this embodiment, there are total of six second flow paths 201B defined within diverter injection assembly 100.

As described above with respect to diverter injection assembly 100, valves 140, 150 are selectively actuated to flow fluids along one or more of the first flow path 201A and second flow paths 201B during operations so as to selectively inject diverter into the high pressure flow from pump assembly 23 (e.g., see FIG. 1). In particular, when fluid is flowing along the first flow path, fluid and pressure communication is maintained through bypass line 108 and inlet manifold 120 to canisters 110, but flow through canisters 110 via outlet manifold 132 to outlet 106 is prevented (or at least restricted) by closed valves 150. However, when fluid is flowing through one or more of the second flow paths 201B, diverter that is stored in corresponding canister(s) 110 is flowed out of outlet 106 and into line 14 (e.g., see FIG. 1) (so that it is then communicated to subterranean well 40 as previously described). During these operations, the actuation of valves 140, 150 (including the timing thereof) may be substantially the same as that described above for diverter injection system 100. Accordingly, this description is not repeated in the interests of brevity.

Figure 7:
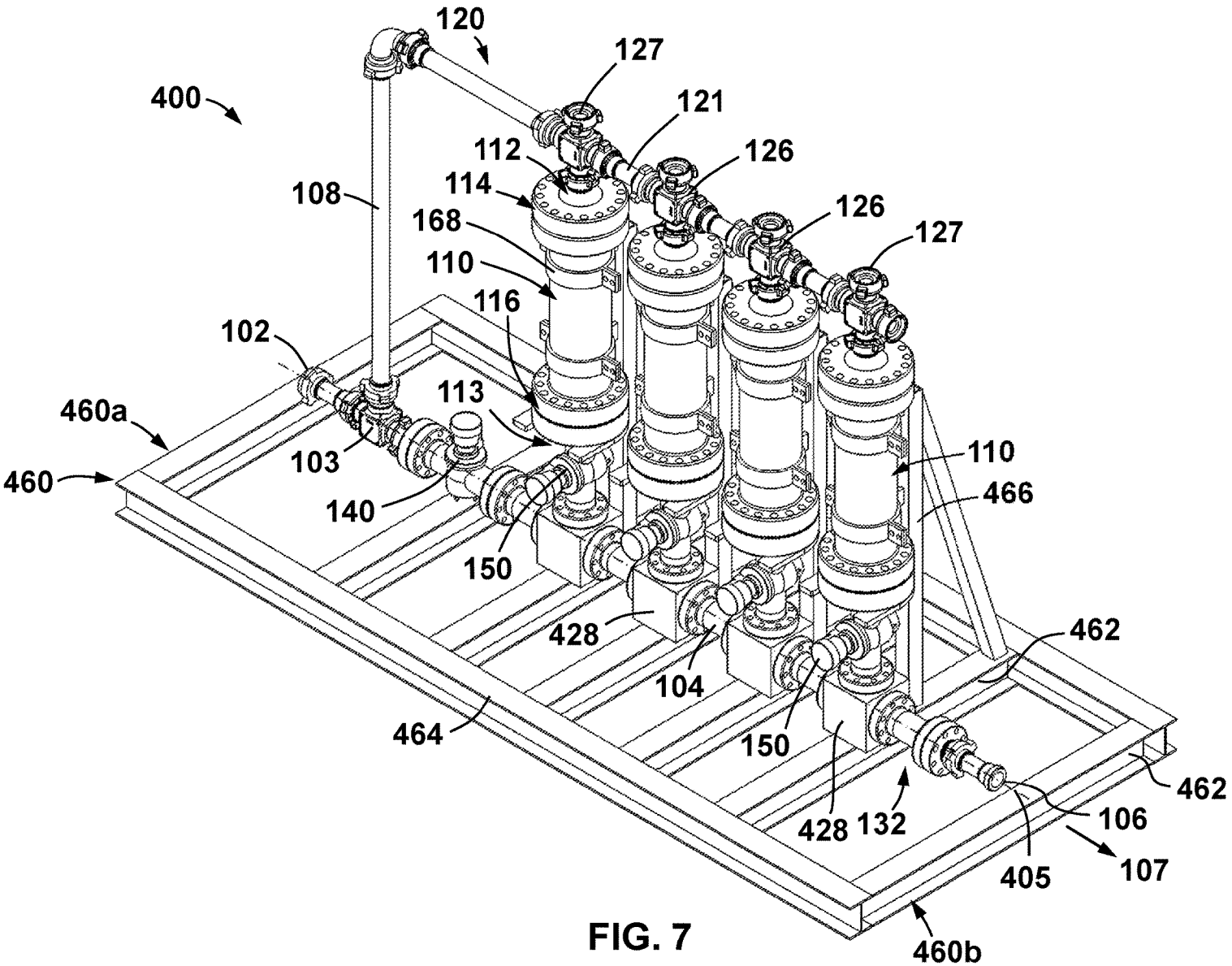
FIG. 7 is a perspective view of another diverter injection system that may be used within the system of FIG. 1 according to some embodiments.

Referring now to FIG. 7, an embodiment of diverter injector system 400 that may be used within hydraulic fracturing system 10 (see FIG. 1) in place of diverter injection system 100 is shown. Generally speaking, diverter injection system 400 includes the same features as those discussed above for the schematic representation of diverter injection system 100 shown in FIG. 2, and diverter injection assembly 200 of FIGS. 3-6. Thus, many of the features of diverter injection systems 100 and 200 are also included within diverter injection system 400 and such components are identified with the same reference numerals in FIG. 7 in the interest of clarity and conciseness. As a result, much of the following discussion regarding diverter injection system 400 will focus on the components or features that are different or additional to those described above for diverter injection systems 100, 200.

In this embodiment, diverter injection system 400 includes a longitudinal axis 405, and is mounted to a skid or base 460. In addition diverter injection system 400 includes inlet 102, outlet 106, canisters 110, bypass line 108, inlet manifold 120, outlet manifold 132, main line 104, and valves 140, 150 as previously described above. In contrast to diverter injection assembly 200, however, diverter injection system 400 omits manifold lines 131 (see e.g., FIGS. 3-6) and the connection lines 130 extend directly between the canisters 110 and main line 104. Together, the connection lines 130 and main line form the outlet manifold 132 as previously described.

Skid 460 includes a first end 460*a*, a second end 460*b* opposite first end 460*a*, a pair of parallel longitudinal support beams 464 extending axially between ends 460*a*, 460*b*, and a plurality of parallel lateral support beams 462 that extend laterally between longitudinal support beams 464 such that each of the beams 464, 462 extend within a common plane. In addition, skid 460 includes a plurality of vertical support beams 466, which extend vertically upward from corresponding ones of lateral support beams 462.

In this embodiment, the plurality of canisters 110 includes four canisters 110 which are arranged axially or linearly along an approximate midline of skid 460 and are axially spaced with respect to longitudinal axis 405. Each of the plurality of canisters 110 is mounted to corresponding ones of vertical support beams 466, such that each canister 110 is generally vertically oriented with inlet 112 and upper flanged connection 114 disposed vertically above outlet 113 and lower flanged connection 116. In this embodiment, one canister 110 is mounted to each vertical support beam 466 via mounting brackets 168.

Generally speaking the plurality of canisters 110 are arranged in parallel fluid communication between inlet manifold 120 and outlet manifold 132. Canisters 110 are in arranged in fluid communication with inlet manifold 120 via corresponding junctions 126 at each inlet 112, and are arranged in fluid communication with outlet manifold 132 via corresponding canister valves 150 and junctions 428. More particularly, canister valves 150 are mounted vertically below corresponding ones of canisters 110, while junctions 428 are position downstream of and below canisters 150. The junctions 428 are disposed along and connected with the main line 104, so that fluid flowing along main line 104 between inlet 102 and outlet 106 passes through the plurality of junctions 428. In addition, inlet 102, tee 103, and main valve 140 are also arranged along main line 104, upstream of the plurality of canisters 110, and outlet 106 is arranged along main line 104 at a position downstream of the plurality of canisters 110.

In the manner described, diverter injection system 400 provides a linear arrangement of canisters 110 along longitudinal axis 405 between inlet 102 and outlet 106. Without being limited to this or any other theory, this linear arrangement (e.g., a linear alignment of inlet 102, main valve 140, outlet manifold 132, and outlet 106) may provide flow benefits as a straight conduit introduces less flow restriction. In addition, the linear arrangement may offer modular expandability to diverter injection system 400 by allowing additional canister 110 and valve 150 assemblies to be added in series with system 400.

In some embodiments, it is contemplated that diverter injection assemblies (e.g., diverter injection assemblies 100, 200, 400, etc.) may be constructed as "modular units" (e.g., in sets of 1, 2, 3, or more canisters 110 and valves 150 in various arrangements) which may be readily coupled to one another (e.g., in series, in parallel, etc.) to expand the diverter injection system (e.g., diverter injection systems 100, 200, 400, etc.) as needed for fracturing operations. Such modular units may be provided with or without an accompanying supporting skid. In some embodiments, the skids of the modular units may be coupled to one another to allow such modular expandability. Alternatively, a skid of a diverter injection system (e.g., diverter injection system 100, 200, 400, etc.) may be provided with additional structure (e.g., lateral support beams 162, 462, vertical support beams 166, 466, etc.) to facility such modular expandability on a common skid.

In the manner described, embodiments disclosed above include systems and methods for injecting diverter materials directly into the high pressure stream (e.g., diverter injection systems 100, 200). Additionally, the above disclosed systems and methods provide a relatively high degree of control over diverter injection timing as well as diverter type and concentration during operations, so the effectiveness of the injected diverter may be increased. As a result, wellbore operations that involve the injection of diverter (and other materials) into a subterranean wellbore may be improved through use of the systems and methods disclosed herein.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system, comprising:

a pump having a discharge; and a diverter injection system fluidly coupled between the discharge of the pump and a subterranean well, wherein the diverter injection system comprises:

a system inlet;

a system outlet;

a canister including an internal volume configured to retain diverter therein;

a first flow path extending between the system inlet and the system outlet that bypasses the canister;

a second flow path that extends from the system inlet, through the canister, and then to the system outlet; and a plurality of valves, wherein actuation of the plurality of valves is configured to selectively switch between the first flow path and the second flow path;

wherein the diverter injection system is configured to place the internal volume of the canister in fluid communication with the system inlet when fluid is flowing through the first flow path and when fluid is flowing through the second flow path.

2. The system of claim 1, wherein the diverter injection system comprises:

a first line extending from the system inlet to the system outlet;

a second line extending from the first line and coupled to an inlet of the canister; and a connection line coupled between an outlet of the canister and the first line, downstream of the second line;

wherein the first flow path extends from the system inlet to the system outlet along the first line; and wherein the second flow path extends from the system inlet, through the second line, the canister, and the connection line, to the system outlet.

3. The system of claim 2, wherein the plurality of valves comprises:

a first valve disposed along the first line between the second line and the system outlet; and a second valve disposed along the connection line.

4. The system of claim 3, comprising a controller coupled to the first valve and the second valve, wherein the controller is configured to:

open the first valve and close the second valve to flow fluid along the first flow path; and close the first valve and open the second valve to flow fluid along the second flow path.

5. The system of claim 4, wherein the controller is configured to close the first valve after opening the second valve to flow fluid along the second flow path.

6. The system of claim 4, wherein the controller is configured to actuate the first valve and the second valve to switch from the first flow path to the second flow path in response to a pressure measurement within the subterranean well.

7. A method, comprising:

(a) discharging a pressurized stream from a pump;

(b) flowing the pressurized stream through a first flow path of a diverter injection system during (a), wherein the diverter injection system includes a system inlet, a system outlet, and a canister, and wherein the first flow path bypasses the canister and extends between the system inlet and the system outlet;

(c) flowing the pressurized stream through a second flow path of the diverter injection system during (a) and after (b), wherein the second flow path extends from the system inlet, through the canister, and to the system outlet;

(d) flowing diverter out of the canister toward a subterranean well during (c); and (e) communicating the pressurized stream with an internal volume of the canister during (b) and (c).

8. The method of claim 7, wherein (a) comprises discharging the pressurized stream at a pressure of 1000-15000 psi.

9. The method of claim 7, wherein (c) comprises actuating a plurality of valves within the diverter injection system to switch from the flowing in (b) to the flowing in (c).

10. The method of claim 9, comprising detecting a pressure within the subterranean well, and wherein (c) comprises actuating the plurality of valves in response to detecting the pressure.

11. The method of claim 10, wherein the diverter injection system comprises:

a first line extending from the system inlet to the system outlet;

a second line extending from the first line and coupled to an inlet of the canister; and a connection line coupled between an outlet of the canister and the first line, downstream of the second line;

wherein the first flow path extends from the system inlet to the system outlet along the first line; and wherein the second flow path extends from the system inlet, through the second line, the canister, and the connection line, to the system outlet.

12. The method of claim 11, wherein the plurality of valves comprises:

a first valve disposed along the first line between the second line and the connection line; and a second valve disposed along the connection line; and wherein the method comprises:

closing the first valve and opening the second valve to switch from the flowing in (b) to the flowing in (c).

13. The method of claim 12, wherein (f) comprises:

(f1) opening the second valve; and then (f2) closing the first valve.

14. A diverter injection system, comprising:

a system inlet configured to be coupled to a discharge of a pump;

a system outlet configured to be coupled to a subterranean well;

a plurality of canisters, wherein each canister comprises an internal volume to hold diverter therein;

a main line extending from the system inlet to the system outlet;

an inlet manifold coupled to an inlet of each of the plurality of canisters;

a bypass line extending from the main line to the inlet manifold;

a plurality of connection lines, wherein each connection line is coupled between an outlet of a corresponding one of the plurality of canisters and the system outlet;

a main valve disposed along the main line between the bypass line and the system outlet; and a plurality of canister valves, wherein each canister valve is disposed along a corresponding one of the plurality of connection lines;

wherein the main valve and the plurality of canister valves are configured to actuate such that flow through the diverter injection system is to switch between:

a first flow path extending from the system inlet to the system outlet along the main line, wherein the first flow path bypasses the inlet manifold and the plurality of canisters ; and a plurality of second flow paths, wherein each second flow path extends from the system inlet, through the bypass line, the inlet manifold, the corresponding one of the plurality of canisters, and the corresponding one of the plurality of connection lines to the system outlet;

wherein the internal volume of each of the canisters is configured to be in fluid communication with the system inlet when fluid is flowed through the first flow path and the plurality of second flow paths.

15. The diverter injection system of claim 14, comprising a controller coupled to the main valve and the plurality of canister valves, wherein the controller is configured to:

open the main valve and close each of the plurality of canister valves to flow fluid along the first flow path; and close the main valve and open one or more of the plurality of canister valves to flow fluid along one or more of the second flow paths.

16. The diverter injection system of claim 15, wherein the controller is configured to close the main valve after opening the one or more of the plurality of canister valves to flow fluid along the one or more of the second flow paths.

17. The diverter injection system of claim 15, wherein the controller is configured to actuate the main valve and one or more of the plurality of canister valves to switch from the first flow path to the one or more of the second flow paths in response to a pressure measurement from within the subterranean well.

18. The diverter injection system of claim 14, wherein each of the plurality of canisters is oriented such that, the inlet of the canister is vertically above the outlet, and wherein each canister valve is disposed vertically below the outlet of the corresponding canister.

* * * * *